US005966740A

United States Patent [19]

Barbe-Vicuna

[11] Patent Number: 5,966,740

[45] Date of Patent: Oct. 19, 1999

[54] LADIES' ASYMMETRICAL SUPPORT UNDERGARMENT

[76] Inventor: Albina Maria Lucrezia Barbe-Vicuna, Willem II Straat 68, NL-5038 BJ Tilburg, Netherlands

[21] Appl. No.: 08/911,634

[22] Filed: Aug. 15, 1997

[30] Foreign Application Priority Data

Aug. 15, 1996 [NL] Netherlands ..... 1003818

[51] Int. Cl.[6] ..... A41C 3/00

[52] U.S. Cl. ..... 2/73; 450/1

[58] Field of Search ..... 450/1, 7, 22, 30, 450/31, 32, 53, 54, 55, 56, 57, 133; 2/107, 117, 409, 73

[56] References Cited

U.S. PATENT DOCUMENTS

| | | | |
|---|---|---|---|
| 3,173,420 | 3/1965 | Mazzoni et al. | 450/58 |
| 4,269,191 | 5/1981 | Evans . | |
| 5,038,414 | 8/1991 | Freeman | 2/409 |
| 5,702,285 | 12/1997 | Orlando | 450/1 |

FOREIGN PATENT DOCUMENTS

| | | |
|---|---|---|
| 1 245 398 | 9/1971 | United Kingdom . |
| 2 199 484 | 7/1988 | United Kingdom . |
| WO 95/05095 | 2/1995 | WIPO . |

*Primary Examiner*—Gloria Hale
*Attorney, Agent, or Firm*—Young & Thompson

[57] ABSTRACT

Ladies' undergarment for the upper part of the body, made of elastic material and provided with a cup front combination, broad shoulder straps and flank panels passing into a back panel. The cup front combination is asymmetrical, with a cup part at one side and flat-running elastic material at the other side, or with two cup parts with different measurements from each other, for exerting adequate therapeutic tissue pressure. The undergarment can be made up of two detachable halves, each provided with fastening means substantially running according to the longitudinal axis of the body, at least one half containing one cup part. The undergarment can be provided at least at one location at the body side with a removable compression plate of thin resilient material, accommodated in a special lining pocket of the undergarment or otherwise.

12 Claims, 2 Drawing Sheets

LADIES' ASYMMETRICAL SUPPORT UNDERGARMENT

Figure 1A:
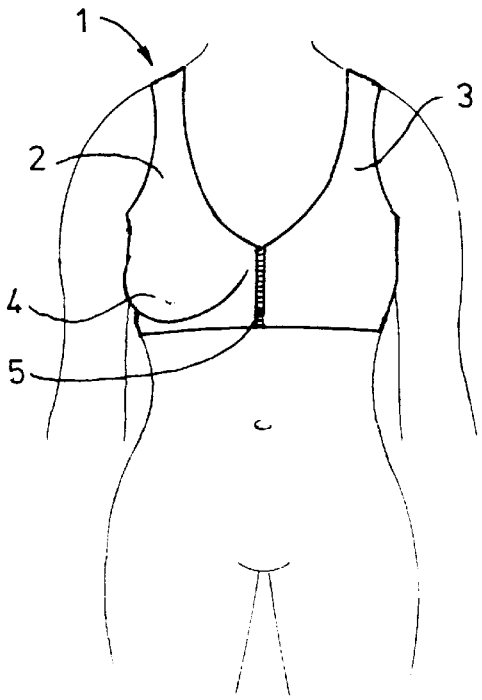

The present invention relates to a ladies' undergarment for the upper part of the body, made of elastic material and provided with a cup front combination, broad shoulder straps and flank panels passing into a back panel.

Such an undergarment is known from, for example, the international application PCT/NL94/00195. This application describes a brassiere with two symmetrical cups of the same measurements. This known undergarment is not suitable for being worn by women with, for example, asymmetrically shaped breasts as the result of acute pathological conditions. Asymmetries of the breast can occur in the case of malignant lymphoedema of the breast, where the breast(s) can assume considerable proportions through progression of the disease.

Asymmetrical breasts are a frequently occurring phenomenon after surgery in breast cancer patients. Such surgery can involve either a breast-saving operation or breast removal (mastectomy), possibly being combined with axillary gland dissection. A breast-saving operation can lead, on the one hand, to reduction in the size of one of the breasts or, on the other hand, actually to enlargement thereof. The resulting asymmetry between the breasts can vary from moderate to very considerable. In order to ensure the greatest possible chance of a tumour being removed completely, in a breast-saving operation, the lumpectomy (surgical removal of a tumour) is in fact preferably carried out as amply as possible. This means that the breast operated on is sometimes considerably reduced in size. In some cases, after a lumpectomy or axillary gland dissection has been performed, a serious form of hyperalgesia occurs postoperatively, actually causing breast enlargement (the term hyperalgesia is explained in detail below). In both cases the difference between one breast and the other can be as much as a number of cup sizes.

In general, surgery and radiotherapy are used for the treatment of breast cancer. In many cases in such treatment a large part of the lymph nodes is removed from lymphatic areas situated near the tumour(s). In particular, damage caused mainly to the primary efferent lymph ducts by, for example, surgery and radiation can lead to reduced lymph drainage capacity in the areas concerned, so-called "relative lymphostasis" or the clinical oedema-free stage. In this stage pathological changes such as accumulations of fibrinoid material already occur in the tissue. In lymphostasis or overt oedema we see accumulations of plasma proteins in the tissue. Both in relative lymphostasis and in lymphostasis these plasma proteins are responsible for stimulating the inflammation which maintains a non-specific inflammatory reaction in the tissue. This is a characteristic tissue reaction in relative lymphostasis and lymphostasis.

On the basis of the above, the pain symptoms occurring post-operatively in oncology patients who have undergone mainly axillary gland dissection can be defined as chronic lymph circulation disorders in which primarily painful congestion and inflammation symptoms occur, so-called hyperalgesia.

Hyperalgesia in the operated hemithorax (the half of the trunk) occurs mostly in the clinical oedema-free stage, both in the case of intermittent-reversible oedema and in the case of slight to moderate oedema.

More serious forms of hyperalgesia occur in the case of malignant lymphoedema, where the lymph channels become blocked through the progression of a malignant process, and during the occurrence of acute radiation reactions during radiation. In the case of acute radiation reactions, owing to hyperaemia caused by the heat effect, increased permeability of the capillary blood vessels to the plasma proteins occurs. Where a painful protein-rich swelling existed already after the operation, a vigorous form of hyperalgesia occurs in the form of a stabbing, burning feeling. In this context seroma formation, haematoma formation, infiltrate, poor-healing wounds, infection and in general all situations in which post-operatively an increased concentration of plasma proteins is already present in the tissue can be mentioned.

The symptoms described above are of a subchronic to chronic nature and can easily be treated, in particular after the use of manual lymph drainage (MLD). Such manual lymph drainage is a special form of non-forcing and gentle massage. Said manual lymph drainage promotes the reabsorption of (protein-rich) tissue fluid in blood and lymph capillaries and stimulates the motor function of the lymph vessels, with the result that the lymph drainage capacity increases and symptoms decrease or disappear. Lymphostasis is prevented or alleviated in such areas by increasing the tissue pressure from the outside. The aetiology, pathogenesis and treatment of hyperalgesia, in this case by the abovementioned manual lymph drainage and subsequent compression therapy, constitutes an entirely new area within lymphology.

The object of the invention then is to provide a ladies' undergarment of the type mentioned in the preamble which eliminates the abovementioned problems in particular where there is asymmetry of the hemithorax, by adequately supporting the mastectomy area and/or the breast(s) of a patient and consolidating and/or increasing the beneficial effects of manual lymph drainage.

This is achieved according to the invention in the case of a ladies' undergarment of the type mentioned in the preamble by the fact that the cup front combination is made asymmetrical, with a cup part at one side and flat-running elastic material at the other side, or with two cup parts with different measurements from each other at one side and the other, for exerting adequate therapeutic tissue pressure. This asymmetrical design is of great importance for therapy in the post-operative phase. On recovery at the end of this phase, for cosmetic reasons the user can again use undergarments with a symmetrical cup front combination, for example containing a prosthesis.

In a further embodiment according to the invention the undergarment is made up of two separate detachable halves, each provided with fastening means substantially running according to the longitudinal axis of the body, at least one half containing one cup part. In the case of this alternative embodiment it is advantageously possible to adapt the undergarment quickly and at low cost to any change in the shape of the operated breast(s), for example by replacing one half part instead of the entire undergarment.

In the case of the abovementioned embodiment with only one cup part this means that, instead of a preformed cup part with certain spatial measurements, the undergarment runs flat over the entire mastectomy area.

In yet another preferred embodiment, at at least one point at the body side the ladies' undergarment according to the invention is provided with a compression plate of resilient material, accommodated in a separate lining pocket of the undergarment or otherwise. By means of a compression plate the ladies' undergarment can be adapted locally even more accurately to the shape of the patient's body, in order to exert the adequate increased therapeutic tissue pressure there. For a detailed description of such a compression plate you are referred, inter alia, to the abovementioned international application.

Many embodiments are conceivable for the ladies' undergarment according to the invention, but the ladies' undergarment is preferably a brassiere or a body stocking.

The invention also relates to a detachable part as described as part of the ladies' undergarment according to the invention.

U.S. Pat. No. 4,269,191 discloses a brassiere with two separate symmetrical cup parts which can be connected to each other in order to form a complete brassiere. The latter is used to accommodate a prosthesis at one side after a breast operation and to enclose the remaining breast at the other side. The two symmetrical parts are attached to each other by way of narrow shoulder straps and narrow breast straps around the upper part of the body. Each cup part can be worn separately, without the other cup part. This contrasts with the two cup parts of the present asymmetrical cup combination, which are always worn at the same time and attached to each other.

GB-A-2,199,484 discloses a symmetrical outside brassiere and an inside brassiere which always have to be worn together. In this case one right or left cup part is formed, for the accommodation of a prosthesis in a pocket between the inside and outside brassiere, and the other cup part is for enclosing the remaining breast. It is generally known that a breast prosthesis is unsuitable for the exertion of therapeutic tissue pressure as in the case of the present undergarment.

GB-A-1,245,398 also discloses a single ladies' undergarment for the upper part of the body, in which the two cup parts are made symmetrically with different inner and outer measurements, for cosmetic reasons. In other words, the identical and symmetrical cup parts are made with variable thickness of the padding mould of the cup part. This is not in line with the lymphological criteria of uniform and uninterrupted pressure, criteria which the present invention does meet.

None of the abovementioned patent publications discloses an asymmetrically designed cup front combination in which the two cup parts have different spatial measurements from each other, in order to ensure adequate therapeutic tissue pressure on the asymmetrical hemithorax.

Figure 1B:
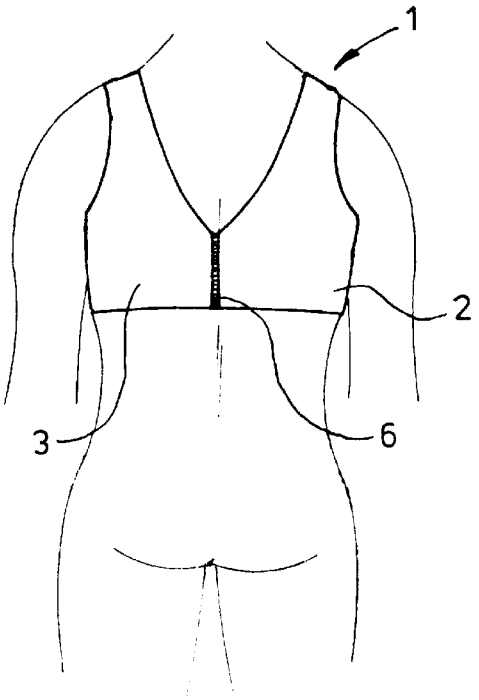

The invention will now be explained in greater detail with reference to the appended drawings, in which:

FIG. 1*a* shows a ladies' undergarment according to the invention in the form of a brassiere, the front side of which is illustrated;

FIG. 1*b* shows the rear side of the brassiere from FIG. 1*a;*

Figure 2A:
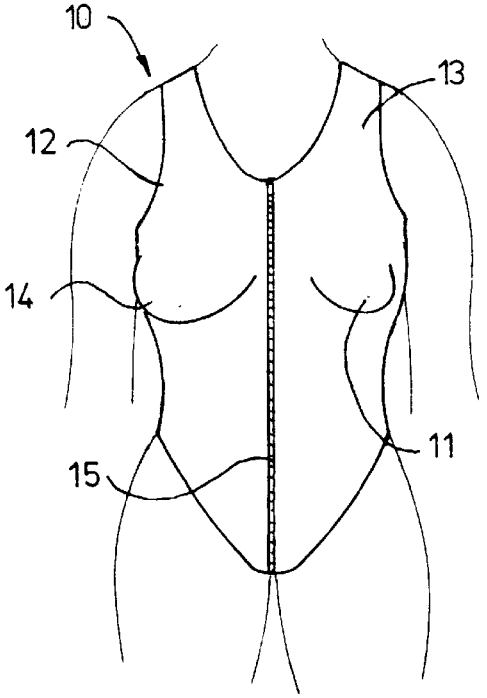
Figure 2B:
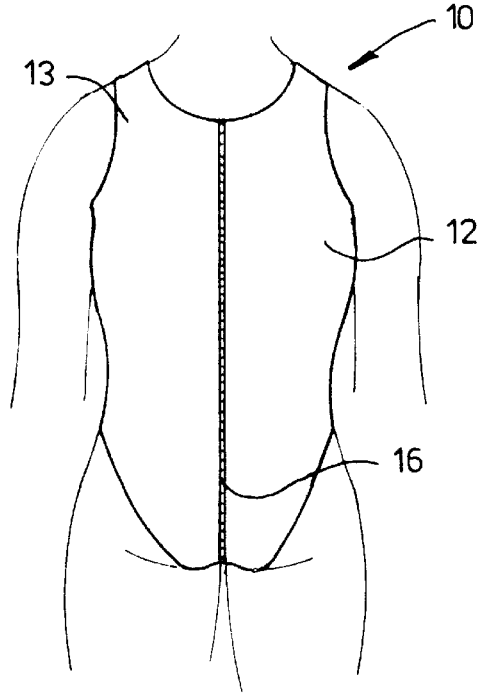

FIG. 2*a* shows a ladies' undergarment according to the invention in the form of a body stocking, the front side of which is illustrated;

FIG. 2*b* shows the rear side of the body stocking according to FIG. 2*a;*

Figure 3A:
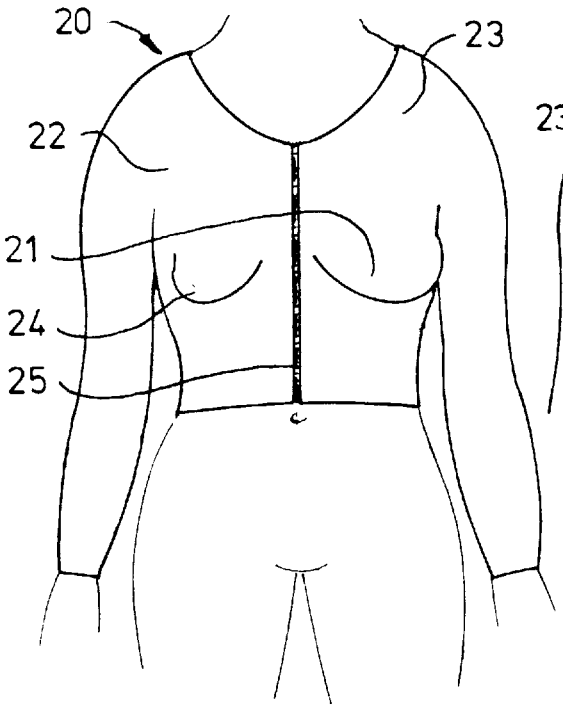
Figure 3B:
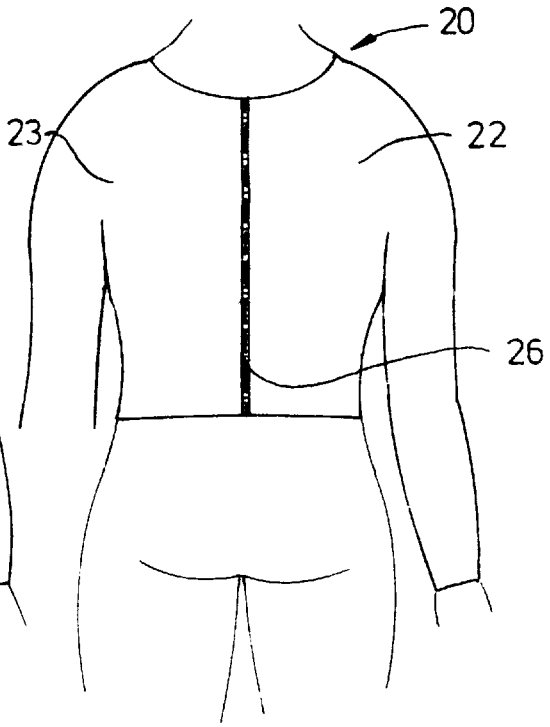

FIG. 3*a* shows a ladies' undergarment according to the invention designed as a mid-length model, the front side of which is illustrated; and FIG. 3*b* shows the rear side of the mid-length model according to FIG. 3*a*.

In FIG. 1*a* the ladies' undergarment according to the invention is in the form of a brassiere 1. Brassiere 1 consists of two detachable parts 2 and 3, which can be attached to each other at the front and at the rear side (FIG. 1*b*) by means of fastening means 5, 6 respectively. In the exemplary embodiment shown, detachable part 2 of brassiere 1 comprises a cup part 4, while detachable part 3 is formed without cup part. In this embodiment the brassiere according to the invention is suitable in particular for patients who have undergone a mastectomy. Owing to the absence of a cup part at the operated side, the brassiere 1 is adapted well to the patient's anatomy. Using suitable materials means that the tissue pressure at the operated side can be locally increased, which prevents or at least alleviates the symptoms described earlier.

In general, suitable materials for the ladies' undergarment according to the invention are all elastic materials known in the field and combinations of elastic and non-elastic materials such as cotton, synthetic material or a combination thereof.

The fastening means used can be any fastening means known in the field. A number of examples are press studs, a zip-fastener, Velcro, and hooks and eyes.

It will be clear that the brassiere 1 according to the invention can be designed in all conceivable models. It also goes without saying that the cup part 4 can be situated either on the left side or on the right side of brassiere 1.

In another embodiment brassiere 1 can also be provided with two cup parts with different spatial measurements from each other (not shown). In this other embodiment the brassiere 1 is excellent for patients who have undergone a breast-saving operation. The brassiere in this embodiment can be adapted very well to the anatomy of the operated breast(s).

FIG. 1*b* shows brassiere 1 at the rear side. It can be seen clearly that brassiere 1 consists of two detachable parts 2 and 3, which can be attached to each other at the rear side by means of fastening means 6 combined with fastening means 5 of FIG. 1*a*. It will be clear to an expert that the ladies' undergarment according to the invention, in this example brassiere 1, can also be in one piece. Brassiere 1 is then, for example, provided only with fastening means 5 or only with fastening means 6.

FIG. 2*a* shows a ladies' undergarment according to the invention in the form of a body stocking 10. Body stocking 10 preferably consists of two detachable parts 12 and 13 which can be attached to each other by means of fastening means 15 and 16 (see FIG. 2*b*). Each detachable part 12, 13 is preferably provided with a maximum of one cup part 14, 11 respectively. The cup parts 14 and 11 have different measurements from each other. This means that the body stocking 10 can be adapted very accurately to the anatomical shape of the breasts. In the case of the ladies' undergarment according to the invention the difference in measurements between the cups can range from one to several cup sizes. In the exemplary embodiment shown, cup part 14 is made larger than cup part 11. It will be clear that this can also be the other way round, depending on the specific anatomy of the patient.

FIG. 2*b* shows the rear side of body stocking 10 from FIG. 2*a*. It can be seen clearly that the detachable parts 12 and 13 are attached to each other by means of fastening means 16 combined with fastening means 15 from FIG. 2*a*. If desired, body stocking 10 can also be in one piece, in which case the body stocking is, for example, provided only with fastening means 15 or only with fastening means 16.

As an alternative, body stocking 10 can also be made with only one cup part, as shown in FIG. 1*a* for brassiere 1. Body stocking 10 can also be made in all conceivable models, and can be adapted to the latest fashion in the field of ladies' undergarments if desired. The body stocking 10 can, for example, be provided with differently shaped bands, and/or a higher or indeed lower cut. Optionally, body stocking 10 is provided with short or long sleeves.

FIG. 3*a* shows a mid-length model of the ladies' undergarment according to the invention. The mid-length model 20 preferably consists of two detachable parts 22 and 23 which are attached to each other by means of fastening means 25 and 26 (see FIG. 3*b*).

In the embodiment shown, mid-length model 20 comprises two cup parts 21 and 24, with different measurements from each other. The difference between the cups 21 and 24 can vary from one to several cup sizes. In the exemplary embodiment shown, cup part 21 is made larger than cup part 24. This can be the other way round where necessary.

FIG. 3*b* shows the rear side of the mid-length model 20 according to FIG. 3*a*. It can be seen clearly that further fastening means 26 are provided, combined with fastening means 25, for attaching the detachable parts 22 and 23 to each other. For an expert it will be clear that the mid-length model 20 can also be made in one piece, in which case, for example, either fastening means 25 alone or fastening means 26 alone are provided.

For all embodiments of ladies' undergarments the fastening means can also be situated in positions other than those shown, for example at the side in the case of undergarments in one piece. In all embodiments, as shown in FIGS. 1 to 3, the undergarment also has broad shoulder straps and high flank panels running towards the armpit, on account of the therapeutic function of the undergarment.

The mid-length model 20 can be designed in all conceivable models. FIGS. 3*a* and 3*b* show the mid-length model 20 provided with sleeves. However, ladies' undergarment 20 can also be made without sleeves if desired.

As an alternative, the mid-length model 20 can be designed with only one cup part, as shown in FIG. 1*a* for brassiere 1. The one cup part can be situated either on part 22 or on part 23.

It is pointed out that in the above the term "cup" or "cup part" must be understood in the most general sense; namely as a preformed space in the ladies' undergarment which in use is situated at the level of the breast. Such a cup can be manufactured by, for example, moulding techniques which are known per se.

It is pointed out that the undergarment 10 is suitable in particular for use in the case of acute pathological conditions in the immediate post-operative phase of a breast cancer patient, i.e. the period in which the post-operative treatment is being given, during radiation, in the case of malignant lymphoedema, and in serious cases of hyperalgesia.

In a preferred embodiment the ladies' undergarment according to the invention is provided at at least one location at the body side with a compression plate made of resilient material, accommodated in a separate lining pocket of the undergarment or otherwise. This lining pocket is preferably made of thin stretch material with few seams, and can be either knitted in or sewn in. The use of such a compression plate ensures that locally there is non-forcing and gentle pressure from the outside, with the result that the tissue pressure can be increased locally.

A compression plate is preferably made of resilient material approximately 0.5–1 cm thick, such as foam rubber, which is designed with flattened-off or bevelled edges. If desired, the compression plate can be clad with a thin material with few seams. The delicate and careful treatment principle of manual lymph drainage is carried further in the finish of this compression plate. Any thick or stiff seam in the surface to be treated has a counterproductive effect and the finish therefore has to meet high standards in order to achieve the desired objective.

The foam rubber of the compression plate in some cases is smooth at least on one surface, and in other cases is provided with little grooves on that surface, with the result that individual compression pads are produced. It is also possible to use individual pads of resilient material which, after fastening to the abovementioned surface of the compression plate, can exert additional pressure on concavities in the area to be treated. These compression pads are particularly suitable for treatment after gland dissection and/or in the case of scars, in which case they can fully or partially fill up the tissue hollow which sometimes comes about.

The compression plate and the individual pad can be made to measure and optionally accommodated in the abovementioned lining pockets.

The shape and measurements of each compression plate are adapted to the anatomical shape and measurements of the place on the body where the compression plate concerned has to exert pressure.

It can be pointed out that all compression plates can be provided with one or more appropriate compression pads. Moreover, all compression plates can be designed either as left or right models. Each compression plate can be provided with Velcro or other known fastening means, in order to hold the compression plate in place.

It will be immediately clear to a person skilled in the art that the compression plates can be adapted either in length or in width to the size of the body area to be treated, without departing from the inventive idea.

We claim:

1. A ladies' undergarment for the upper part of a body provided with a cup front part, shoulder straps, and flank panels passing into a back panel, wherein the cup front part is made asymmetrical and comprises an elastic first section for overlying a body area which has been operated upon and a second section comprising a cup part, the first section being a flat-running elastic material, wherein the first section exerts a uniform and continuous pressure on the underlying area when the undergarment is worn, this pressure being higher than a pressure exerted by the second section and providing therapeutic tissue pressure for alleviating effects of lymph circulation disorders.

2. The ladies' undergarment according to claim 1, in which the undergarment is made up of two separate detachable halves, each half being provided with fastening means substantially running according to the longitudinal axis of the body, at least one half containing one cup part.

3. The ladies' undergarment according to claim 1, in which the undergarment is provided with a removable compression plate of thin resilient material at least at one location at the body side.

4. The ladies' undergarment according to claim 3, in which the undergarment is provided with a separate lining pocket for accommodation of the compression plate.

5. The ladies' undergarment according to claim 1, in which the ladies' undergarment is a brassiere.

6. The ladies' undergarment according to claim 1, in which the ladies' undergarment is a body stocking.

7. A ladies' undergarment for the upper part of a body provided with a cup front part, shoulder straps, and flank panels passing into a back panel, wherein the cup front part is made asymmetrical and comprises an elastic first section for overlying a body area which has been operated upon and a second section comprising a cup part, the first section being a cup part with different measurements from the cup part of the second section, wherein the first section exerts a uniform and continuous pressure on the underlying area when the undergarment is worn, this pressure being higher than a pressure exerted by the second section and providing therapeutic tissue pressure for alleviating effects of lymph circulation disorders.

8. The ladies' undergarment according to claim 7, in which the undergarment is made up of two separate detachable halves, each half being provided with fastening means substantially running according to the longitudinal axis of the body.

9. The ladies' undergarment according to claim 7, in which the undergarment is provided with a removable compression plate of thin resilient material at least at one location at the body side.

10. The ladies' undergarment according to claim 7, in which the undergarment is provided with a separate lining pocket for accommodation of the compression plate.

11. The ladies' undergarment according to claim 7, in which the ladies' undergarment is a brassiere.

12. The ladies' undergarment according to claim 7, in which the ladies' undergarment is a body stocking.

* * * * *